US010386776B2

(12) United States Patent
Wu

(10) Patent No.: US 10,386,776 B2
(45) Date of Patent: Aug. 20, 2019

(54) CONNECTING MEMBER AND ROLLER UNIT OF ELECTRONIC IMAGE-FORMING APPARATUS HAVING THE SAME

(71) Applicant: GENERAL PLASTIC INDUSTRIAL CO., LTD., Taichung (TW)

(72) Inventor: Yi-Chia Wu, Taichung (TW)

(73) Assignee: GENERAL PLASTIC INDUSTRIAL CO., LTD., Taichung (TW)

( * ) Notice: Subject to any disclaimer, the term of this patent is extended or adjusted under 35 U.S.C. 154(b) by 38 days.

(21) Appl. No.: 15/942,887

(22) Filed: Apr. 2, 2018

(65) Prior Publication Data

US 2019/0219960 A1 Jul. 18, 2019

(30) Foreign Application Priority Data

Jan. 17, 2018 (TW) ..... 107101716 A

(51) Int. Cl.
*G03G 15/00* (2006.01)
*G03G 15/08* (2006.01)

(52) U.S. Cl.
CPC ..... *G03G 15/757* (2013.01); *G03G 15/0806* (2013.01)

(58) Field of Classification Search
CPC ..... G03G 15/757; G03G 21/1842; G03G 21/1647
See application file for complete search history.

(56) References Cited

U.S. PATENT DOCUMENTS

2012/0183331 A1 7/2012 Huang et al.
2013/0322923 A1* 12/2013 Ikeda ..... B29D 99/00 399/117
2016/0018777 A1 1/2016 Iijima et al.
2016/0282798 A1 9/2016 Matsuoka et al.

* cited by examiner

*Primary Examiner* — Erika J Villaluna
(74) *Attorney, Agent, or Firm* — Muncy, Geissler, Olds & Lowe, P.C.

(57) ABSTRACT

A connecting member includes a tube portion, a bottom portion provided at an end of the tube portion, an opening provided at the other end of the tube portion, a first limit portion extending from the bottom portion toward the opening in a way that a gap is left between the first limit portion and an internal periphery of the tube portion, and a second limit portion located inside the tube portion and spacedly facing the first limit portion. The first and second limit portions have first and second notches. The connecting member is used in a roller unit of an electronic image-forming apparatus. The connecting member is capable of being coupled with a rotational force receiving member in a way that the rotational force receiving member is freely swingable within an angle range relative to the connecting member without being detached from the connecting member.

12 Claims, 12 Drawing Sheets

CONNECTING MEMBER AND ROLLER UNIT OF ELECTRONIC IMAGE-FORMING APPARATUS HAVING THE SAME

BACKGROUND OF THE INVENTION

1. Field of the Invention

The present invention relates generally to an electronic image-forming apparatus and more particularly, to a roller unit of an electronic image-forming apparatus and a connecting member of the roller unit.

2. Description of the Related Art

A normal electronic image-forming apparatus, such as photocopier or printer, is generally equipped with a replaceable toner cartridge therein. Inside the toner cartridge, a plurality of roller units, such as photosensitive roller unit, developer roller unit, etc., are installed. These roller units each have a rotatable roller, which is disposed inside a housing of the toner cartridge, and a connecting member connected to an end of the rotatable roller, such that the roller and the connecting member are rotatable synchronously. The connecting member is further coupled with a rotational force receiving member, which protrudes outside the housing of the toner cartridge and is engageable with a driving head provided inside the electronic image-forming apparatus. As a result, when the driving head rotates, the roller is driven by the connecting member via the rotational force receiving member to rotate relative to the housing of the toner cartridge so as to perform developing or photosensitive work.

To fulfill the requirements of installing the toner cartridge into the electronic image-forming apparatus and dismantling the toner cartridge from the electronic image-forming apparatus, the rotational force receiving member has to be coupled to the connecting member in a freely swingable manner. Therefore, how to assemble the rotational force receiving member with the connecting member to enable that the rotational force receiving member is freely swingable in a certain range of angle without being detached from the connecting member is a technical issue to be solved by the manufacturers in this industry field.

SUMMARY OF THE INVENTION

The present invention has been accomplished in view of the above-noted circumstances. It is an objective of the present invention to provide a roller unit of an electronic image-forming apparatus, which enables that the rotational force receiving member is freely swingable within a certain range of angle relative to the connecting member without being detached from the connecting member.

Another objective of the present invention is to provide a connecting member adapted to be coupled with a rotational force receiving member in a way that the rotational force receiving member is freely swingable within a certain range of angle relative to the connecting member without being detached from the connecting member.

To attain the above objectives, the present invention provides a roller unit of an electronic image-forming apparatus comprises a roller, a connecting member, a rotational force receiving member, and a resilient member. The connecting member has a tube portion fixedly mounted to an end of the roller, a bottom portion provided at an end of the tube portion, an opening provided at the other end of the tube portion, a first limit portion extending from the bottom portion toward the opening in a way that a gap is left between the first limit portion and an internal periphery of the tube portion, and a second limit portion located inside the tube portion and spacedly facing the first limit portion. The tube portion has an axis extending therethrough. The first limit portion has a first notch, and the second limit portion has a second notch. The rotational force receiving member has an axle portion parallel to the axis of the tube portion of the connecting member, and two limit posts protruding radially from the axle portion and extending into the first notch and the second notch, respectively. The resilient member is connected between the connecting member and the rotational force receiving member in such a way that the rotational force receiving member is freely swingable from the axis toward any direction at a predetermined angle relative to the connecting member.

In another aspect, the present invention provides a connecting member comprising a tube portion, a bottom portion provided at an end of the tube portion, an opening provided at the other end of the tube portion, a first limit portion, and a second limit portion. The first limit portion extends from the bottom portion toward the opening in a way that a gap is left between the first limit portion and an internal periphery of the tube portion. The first limit portion has a first notch. The second limit portion is located inside the tube portion and spacedly faces the first limit portion. The second limit portion has a second notch. As a result, the connecting member is capable of being coupled with a rotational force receiving member in a way that the rotational force receiving member is freely swingable within an angle range relative to the connecting member without being detached from the connecting member.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
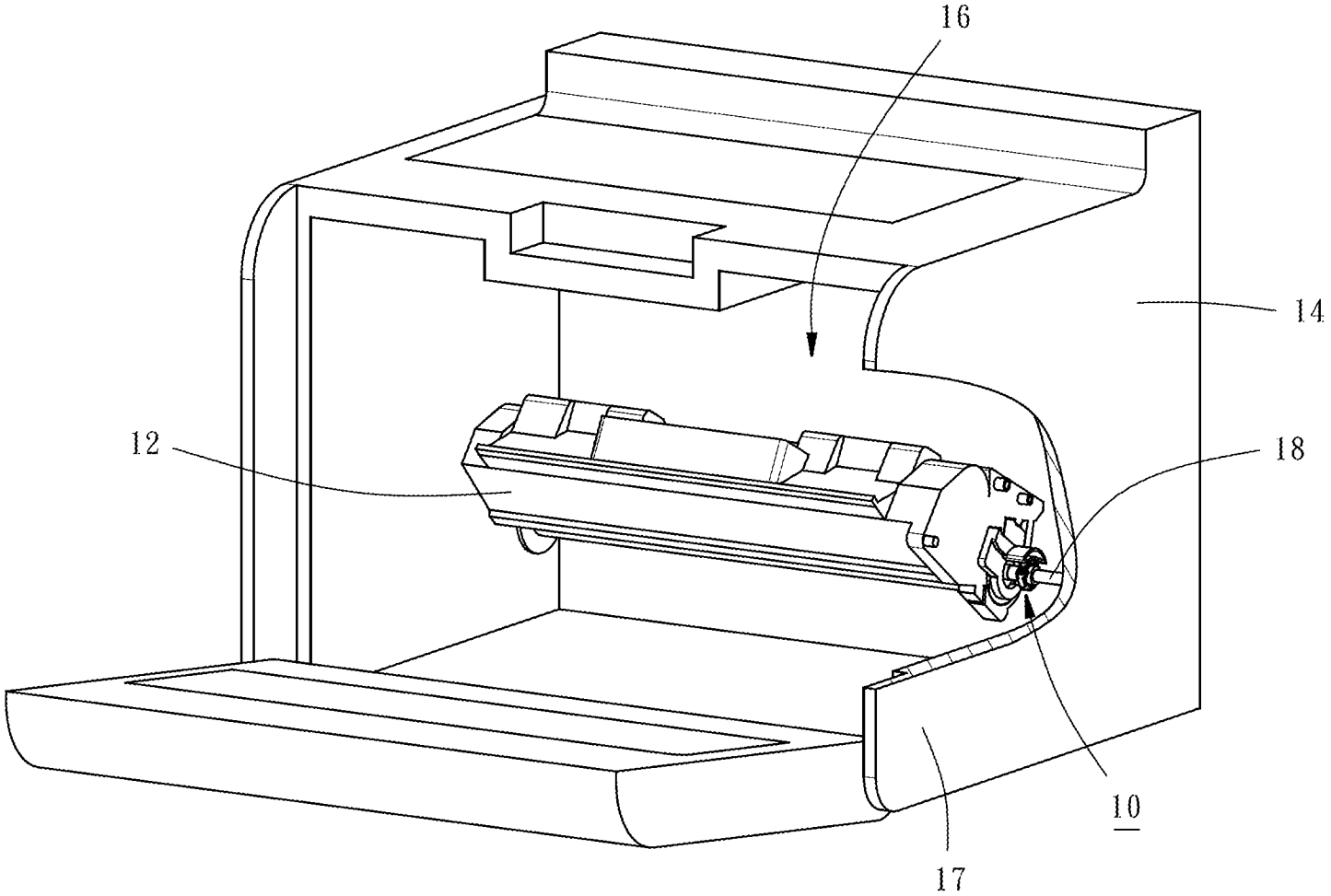
FIG. 1 is a schematically perspective view, showing that a roller unit in accordance with a first embodiment of the present invention is installed in an electronic image-forming apparatus.
Figure 2:
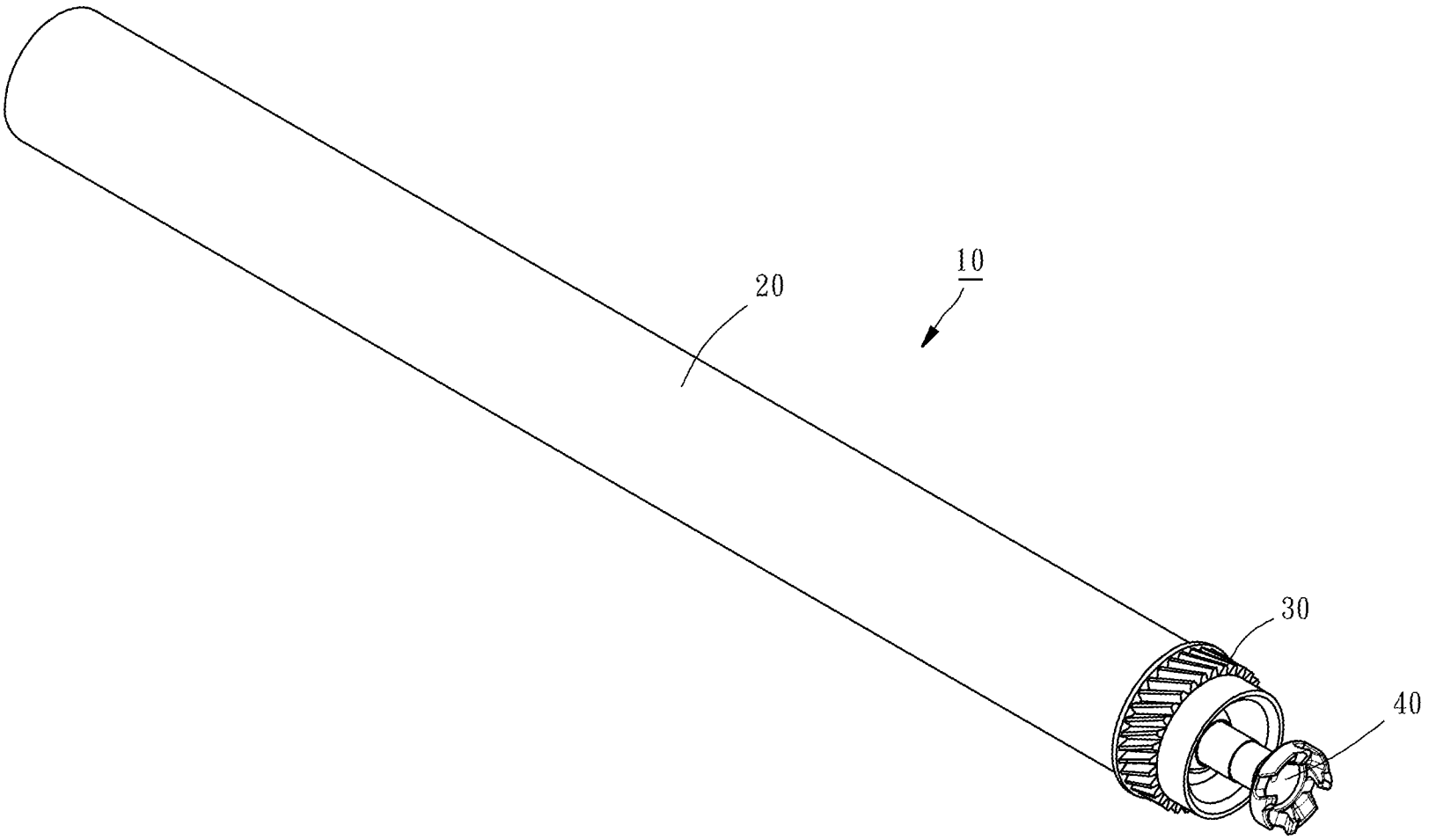
FIG. 2 is a perspective view of the roller unit in accordance with the first embodiment of the present invention.
Figure 3:
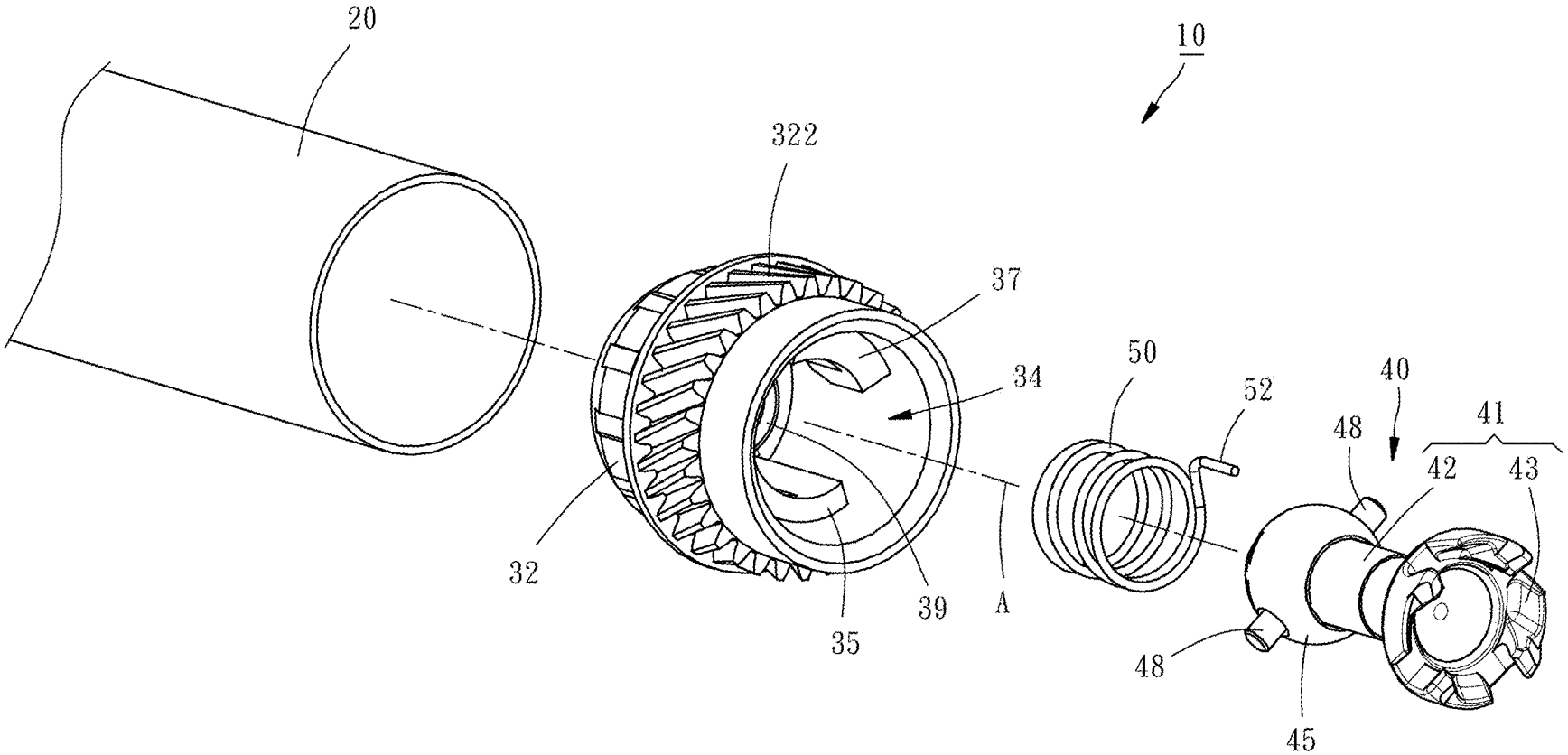
FIG. 3 is an exploded view of the roller unit in accordance with the first embodiment of the present invention.

Hereunder three embodiments will be described with accompanying drawings for illustrating technical features and structures of the present invention. As shown in FIG. 1, a roller unit 10 provided in accordance with a first embodiment of the present invention is disposed in a toner cartridge 12 that is installed inside an electronic image-forming apparatus 14, such as photocopier or printer. Specifically, the electronic image-forming apparatus 14 is provided at an inside thereof with an accommodation 16, in which the toner cartridge 12 is disposed, and a lateral wall 17 disposed with a driving member 18. The driving member 18 extends into the accommodation 16 and is engageable with the roller unit 10 of the toner cartridge 12 for driving the roller unit 10 to rotate. Referring to FIGS. 2 and 3, the roller unit 10 is composed of a roller 20, a connecting member 30, a rotational force receiving member 40, and a resilient member 50.

The roller 20 is an elongated circular tube, which may be realized as a photosensitive drum, a developer roller or other functional rollers.

Figure 4A:
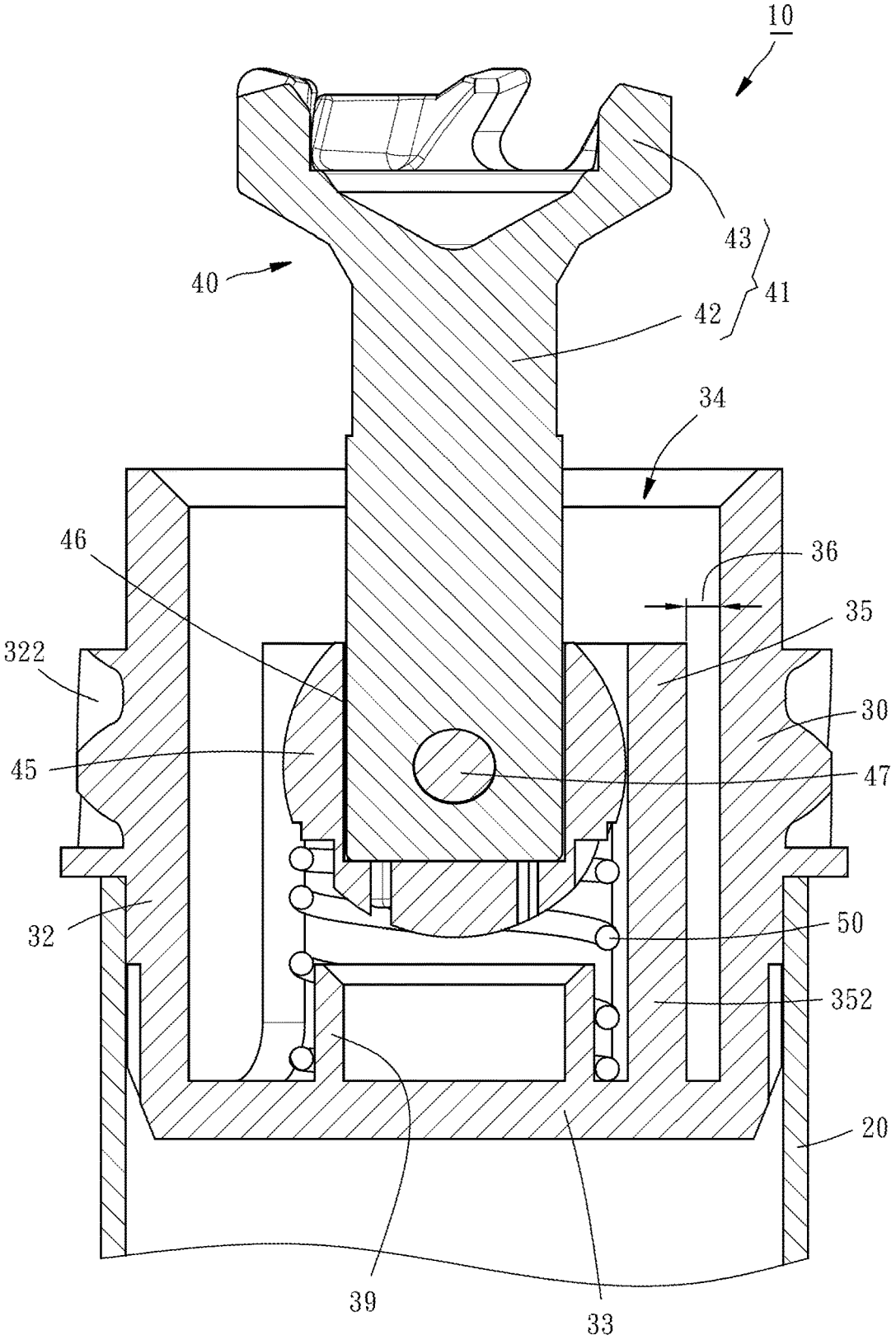
FIGS. 4A and 4B are sectional views taken along different directions of the roller unit in accordance with the first embodiment of the present invention.
Figure 4B:
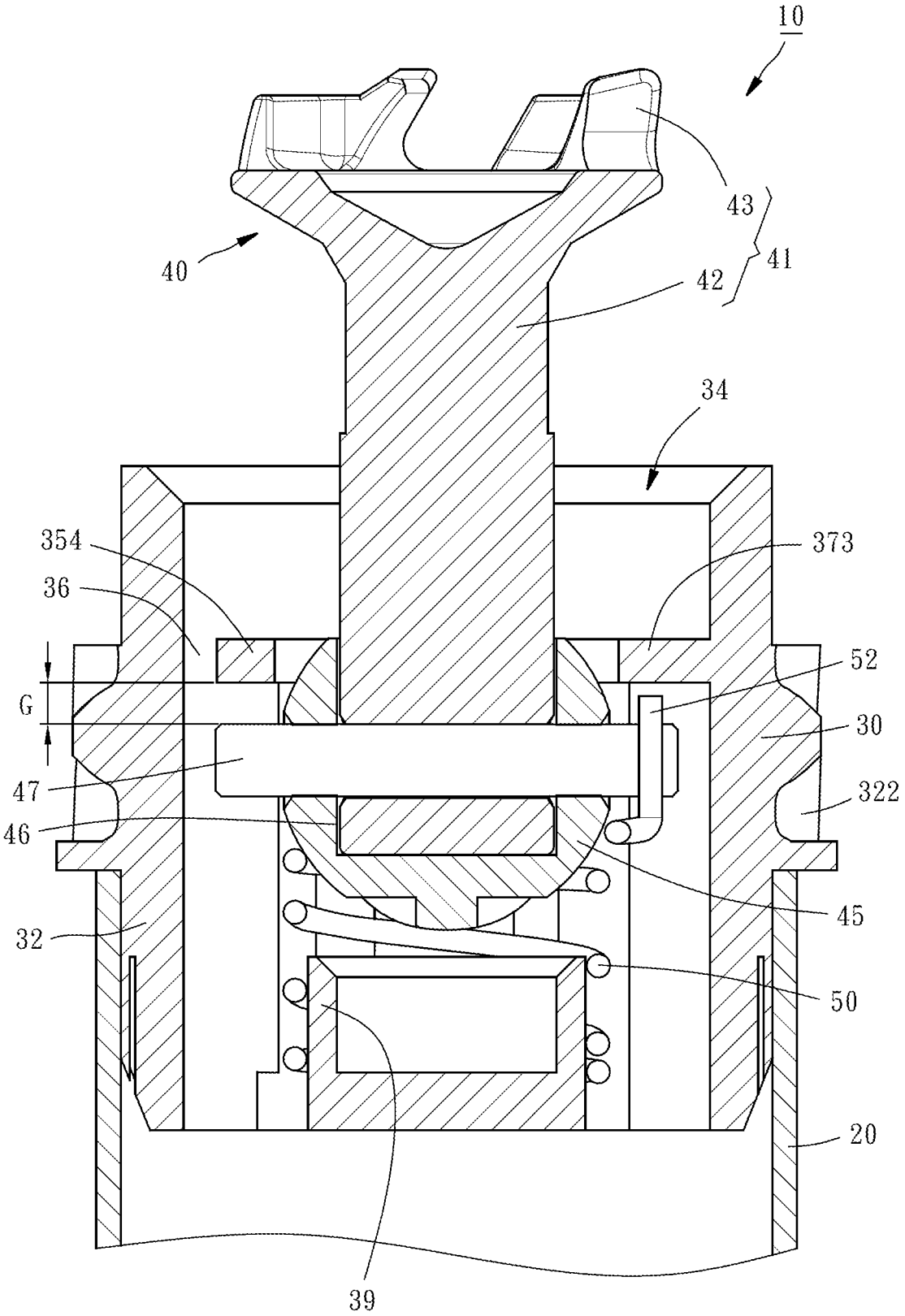

As shown in FIGS. 3, 4A and 4B, the connecting member 30 has a tube portion 32 fixedly mounted to an end of the roller 20, a bottom portion 33 provided at an end of the tube portion 32, an opening 34 provided at the other end of the tube portion 32, a first limit portion 35 extending from the bottom portion 33 toward the opening 34 in a way that a gap 36 is left between the first limit portion 35 and an internal periphery of the tube portion 32, and a second limit portion 37 located inside the tube portion 32 and spacedly facing the first limit portion 35.

Figure 5:
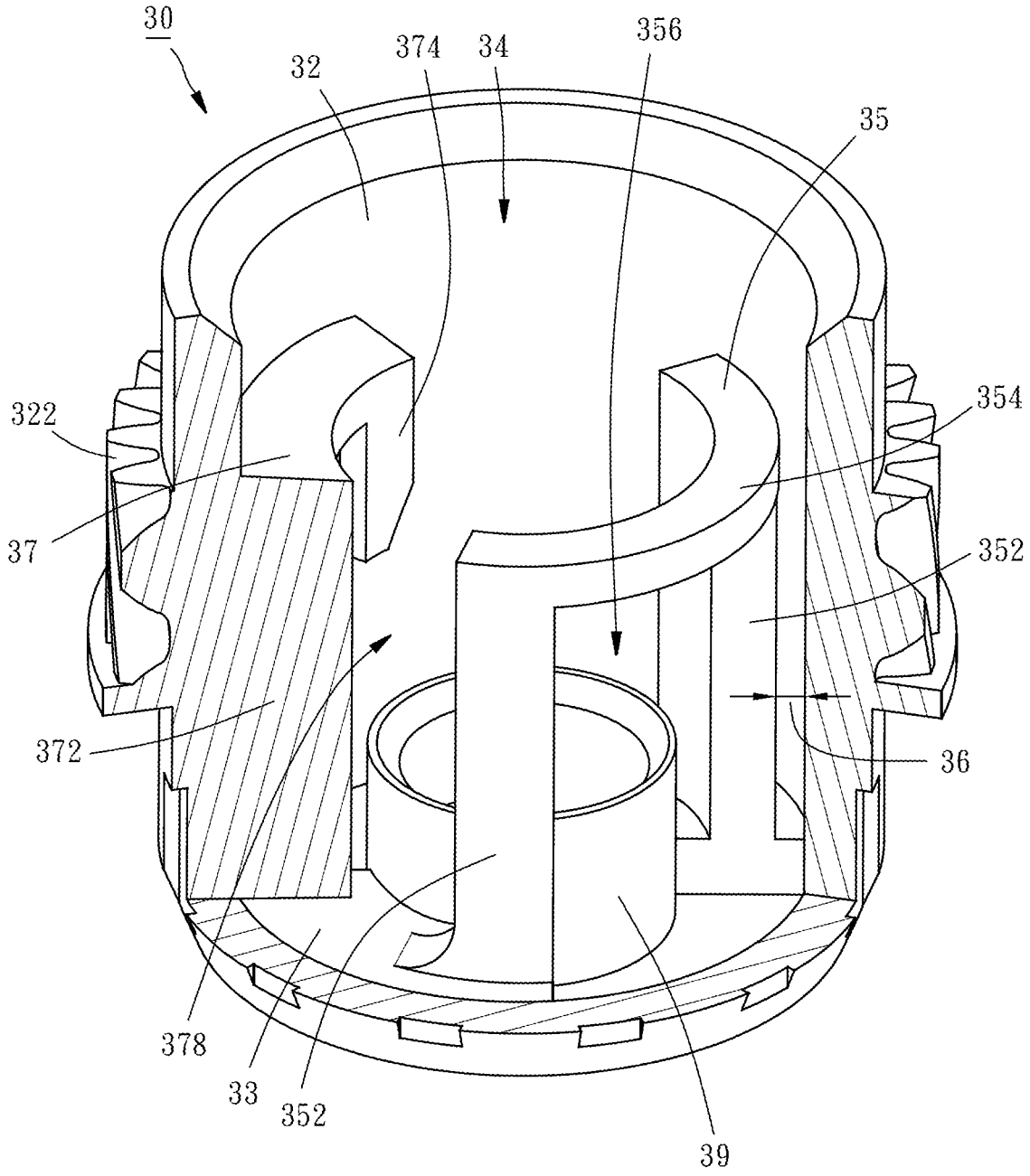
FIG. 5 is a cutaway perspective view of the connecting member of the roller unit in accordance with the first embodiment of the present invention.
Figure 6:
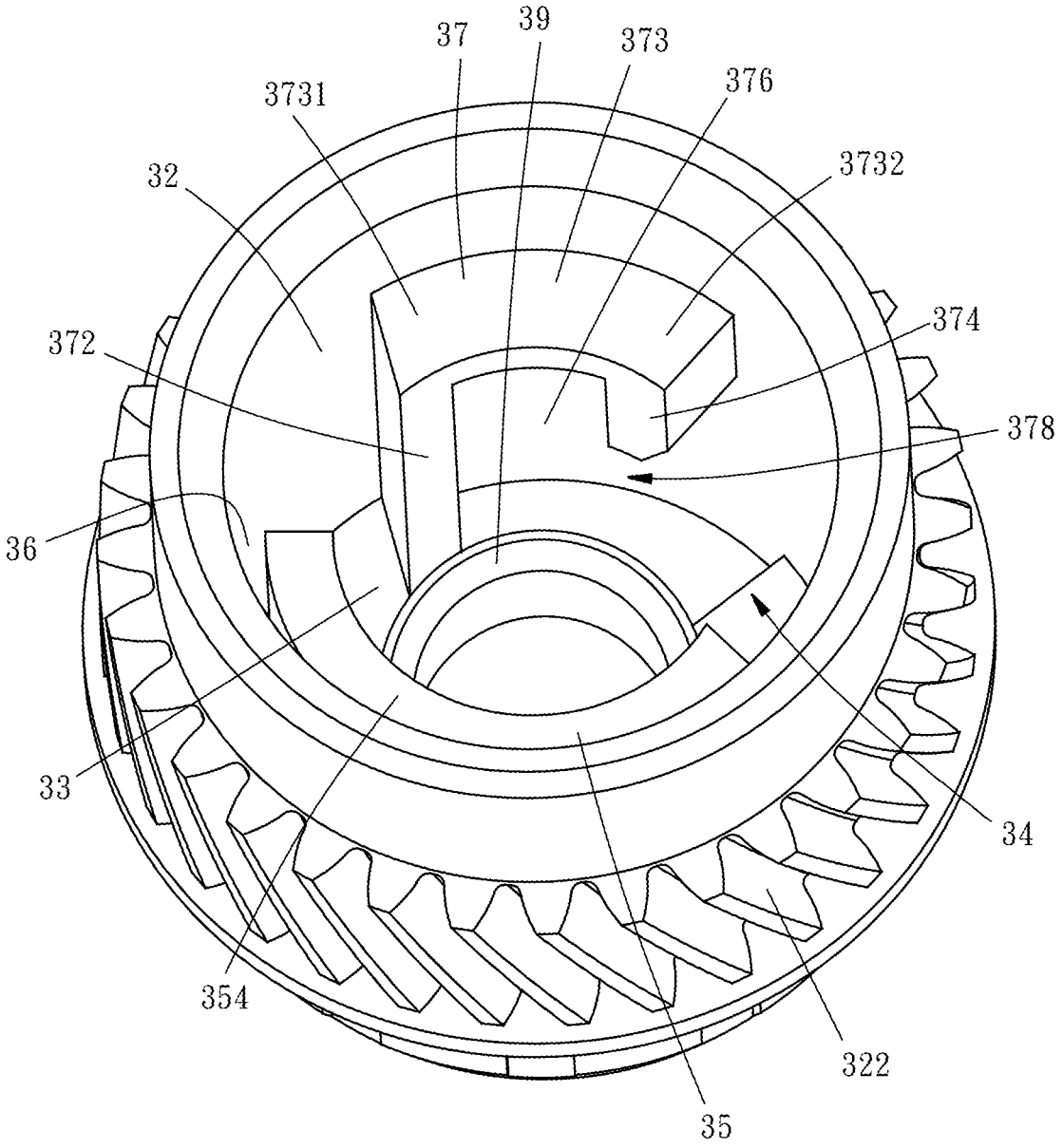
FIG. 6 is another perspective view of the connecting member of the roller unit in accordance with the first embodiment of the present invention.

The tube portion 32 has an axis A extending therethrough. A middle section of the tube portion 32 is provided with teeth 322 engageable with a gear (not shown). An end portion of the tube portion 32 has a relatively smaller diameter and is inserted into the roller 20 such that the connecting member 30 and the roller 20 are fixedly connected with each other. Referring to FIG. 5, the first limit portion 35 is provided with two axially extending portions 352 extending from the bottom portion 33 toward the opening 34 and paralleling the axis A, an arc portion 354 connected between the two distal ends, i.e. top ends, of the two axially extending portions 352, and a notch 356 surrounded by the axially extending portions 352 and the arc portion 354. Referring to FIG. 6, the second limit portion 37 protrudes from the internal periphery of the tube portion 32 toward the first limit portion 35 and has a first axially extending portion 372, an arc portion 373, a second axially extending portion 374 and a second notch 376. The first axially extending portion 372 has an end (i.e., the bottom end) connected with the bottom portion 33, and the other end (i.e., the top end) connected with a first end 3731 of the arc portion 373. The second axially extending portion 374 has an end (i.e., the top end) connected with a second end 3732 of the arc portion 373, and the other end (i.e., the bottom end) spaced from the bottom portion 33 at a predetermined distance, such that a breach 378 is left between the bottom end of the second axially extending portion 374 and the bottom portion 33. The second notch 376 is surrounded by the first axially extending portion 372, the arc portion 373 and the second axially extending portion 374, and communicated with the breach 378. The connecting member 30 may, but not limited to, be made by plastic injection molding integrally or by a combination of a plurality of elements.

Figure 7:
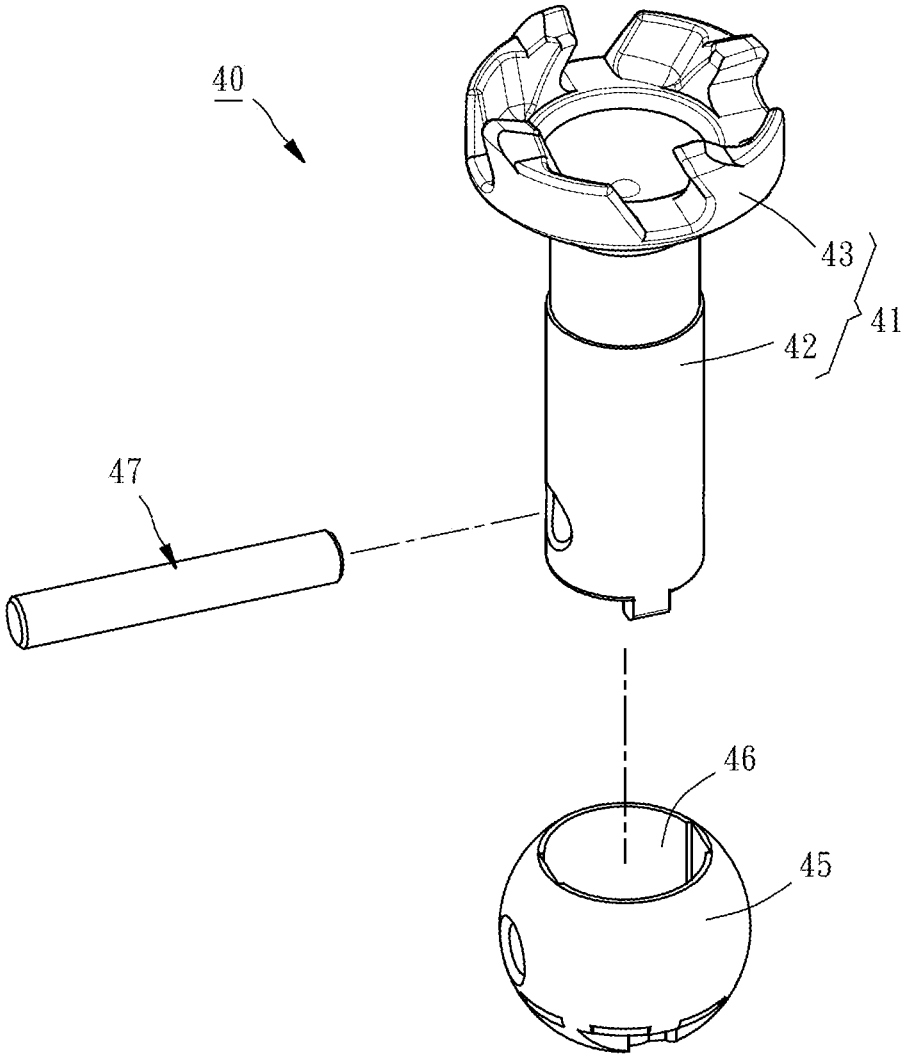
FIG. 7 is an exploded view of the rotational force receiving member of the roller unit in accordance with the first embodiment of the present invention.

As shown in FIGS. 3, 4A and 4B, the rotational force receiving member 40 has an axle portion 42 parallel to the axis A of the tube portion 32 of the connecting member 30, and two limit posts 48 protruding outwardly and radially from the axle portion 42 and extending into the first notch 356 and the second notch 376, respectively. In this way, when the rotational force receiving member 40 rotates counterclockwise, the two limit posts 48 will abut against one of the axially extending portions 352 of the first limit portion 35 and the first axially portion 372 of the second limit portion 37 respectively, such that the connecting member 30 can be driven by the rotational force receiving member 40 to rotate synchronously. The structure of the rotational force receiving member 40 may be variously modified and can have a basic function by means of the foregoing basic structure. In this embodiment, the rotational force receiving member 40 is composed of an axle component 41, a sphere 45 and a limit pin 47. As shown in FIG. 7, the axle component 41 has the axle portion 42 and a claw portion 43 that is integrally provided at an end of the axle portion 42 and adapted to be engaged with the driving member 18 of the electronic image-forming apparatus 14, such that the axle component 41 can be driven by the driving member 18 to rotate. The sphere 45 has a hollow chamber 46, into which the axle component 41 is inserted. The limit pin 47 penetrates through the sphere 45 and the axle portion 42 along a radial direction of the axle component 41 in a way that two end portions of the limit pin 47 protrude out of the sphere 45 and form the two limit posts 48. Because the sphere 45 is exactly accommodated between the first limit portion 35 and the second limit portion 37 of the connecting member 30, the center of the sphere 45 will be always kept on the axis A no matter how deep the axle portion 42 of the rotational force receiving member 40 is swingably biased relative to the axis A. To install the rotational force receiving member 40 into the connecting member 30, one limit post 48 is inserted into the first notch 356 first, and then the other limit post 48 is inserted into the second notch 376 though the breach 378.

Figure 8:
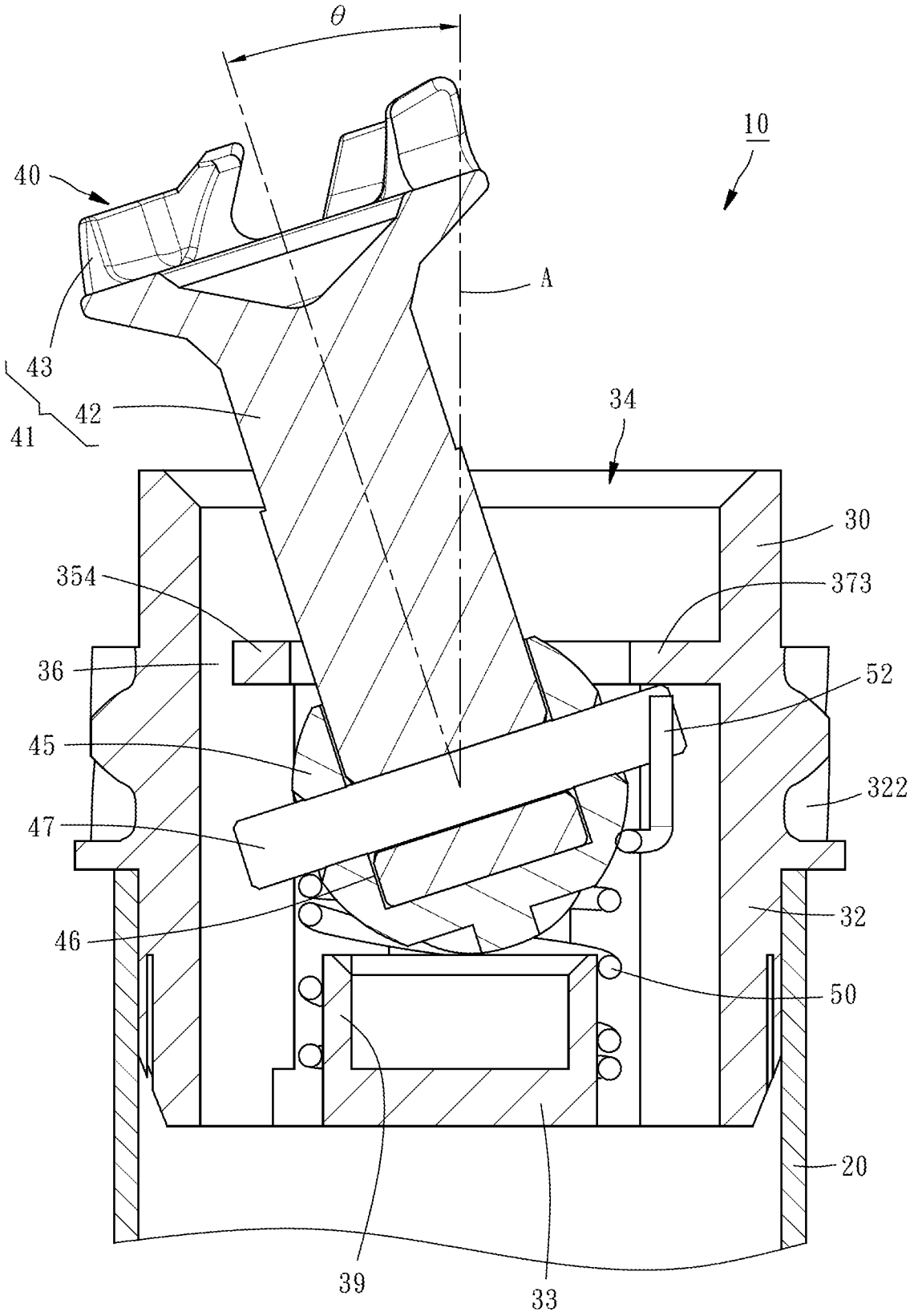
FIG. 8 is a schematic view showing that the roller unit in accordance with the first embodiment of the present invention is in use.
Figure 9:
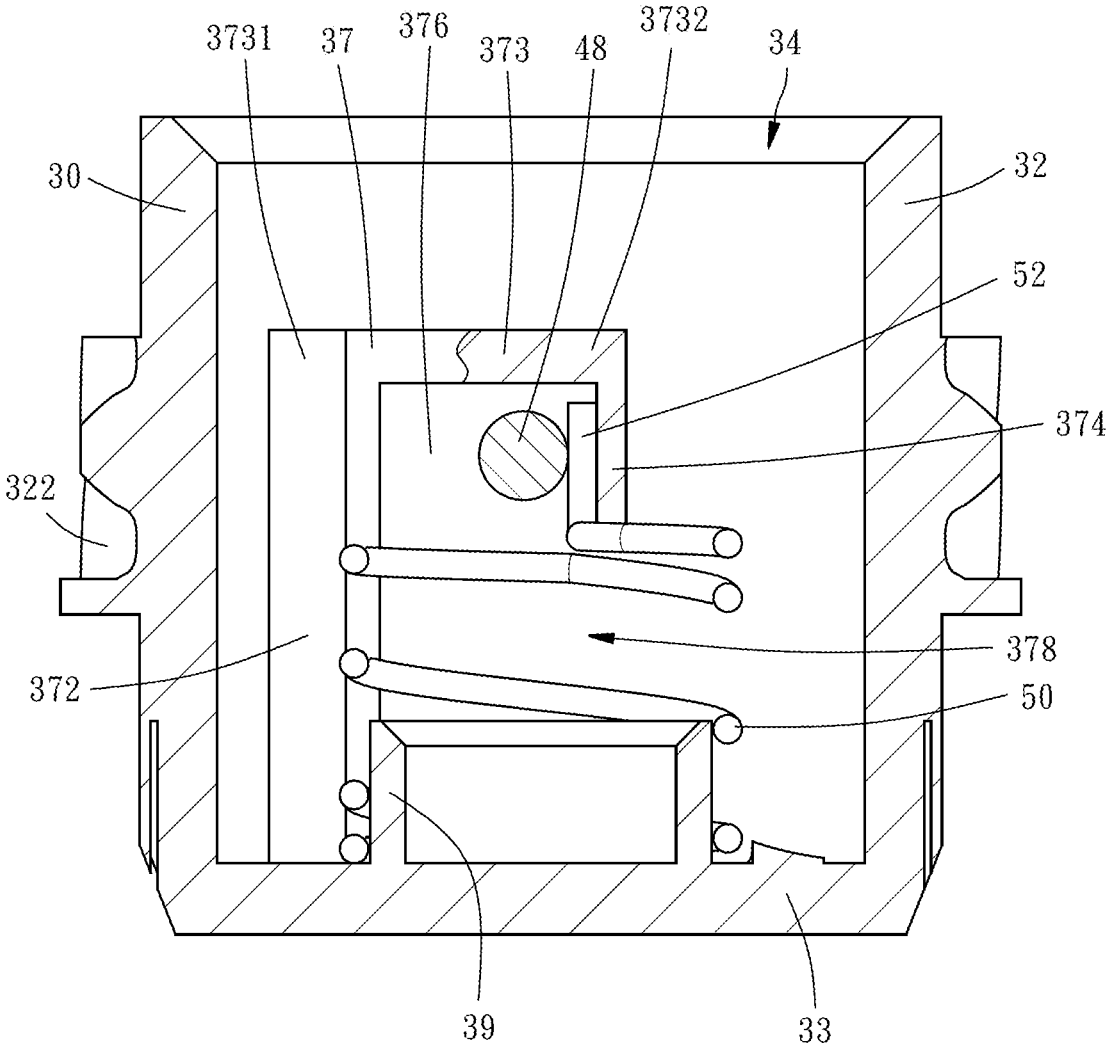
FIG. 9 is a sectional view of a part of the roller unit in accordance with the first embodiment of the present invention, showing the relationship among a stopper portion of the resilient member and neighboring members.

As shown in FIGS. 3, 4A and 4B, the resilient member 50 is disposed between the connecting member 30 and the rotational force receiving member 40. When viewed from the view angles of FIGS. 4A and 4B, the resilient member 50 has a bottom end abutted with the bottom portion 33 of the connecting member 30, and a top end abutted with the rotational force receiving member 40. It is to be especially mentioned that the resilient member 50 does not push the rotational force receiving member 40 upward, but is connected between the connecting member 30 and the rotational force receiving member 40 in a way that a gap G is left between one of the two limit posts 48 and the arc portion 354 of the first limit portion 35 and between the other of the two limit posts 48 and the arc portion 373 of the second limit portion 37. In this way, the rotational force receiving member 40 is freely swingable from the axis A toward any direction at a predetermined angle θ relative to the connecting member 30, as shown in FIG. 8. For the resilient member 50, various types of resilient members may be used. In this embodiment, the resilient member 50 is realized as a coil spring having an end sleeved onto a protrusion ring 39 that extends from the bottom portion 33 of the connecting member 30 toward the opening 34, such that the bottom end of the resilient member 50 is held in position, as shown in FIGS. 4A and 4B. Further, as shown in FIG. 9, an end portion of the resilient member 50, which is connected with the rotational force receiving member 40, is provided with an upwardly extending stopper portion 52, which is located inside the second notch 376 and between one of the limit posts 48 of the rotational force receiving member 40 and the second axially extending portion 374 of the second limit portion 37. In this way, even if the rotational force receiving member 40 receives an external force to move downwardly and compress the resilient member 50, the limit post 48 will not escape out of the second notch 376 from the breach 378 due to the fact that the limit post 48 is restricted by the stopper portion 52.

With the above-mentioned structure, the rotational force receiving member 40 is freely swingable within a certain range of angle θ relative to the connecting member 30 and will not be detached from, the connecting member 30. When the toner cartridge 12 is installed into the electronic image-forming apparatus 14, the rotational force receiving member 40 is capable of being engaged with the driving member 18. As a result, when the driving member 18 rotates, the roller 20 is driven by the connecting member 30 via the rotational force receiving member 40 to rotate so as to achieve developing or photosensitive function.

Figure 10:
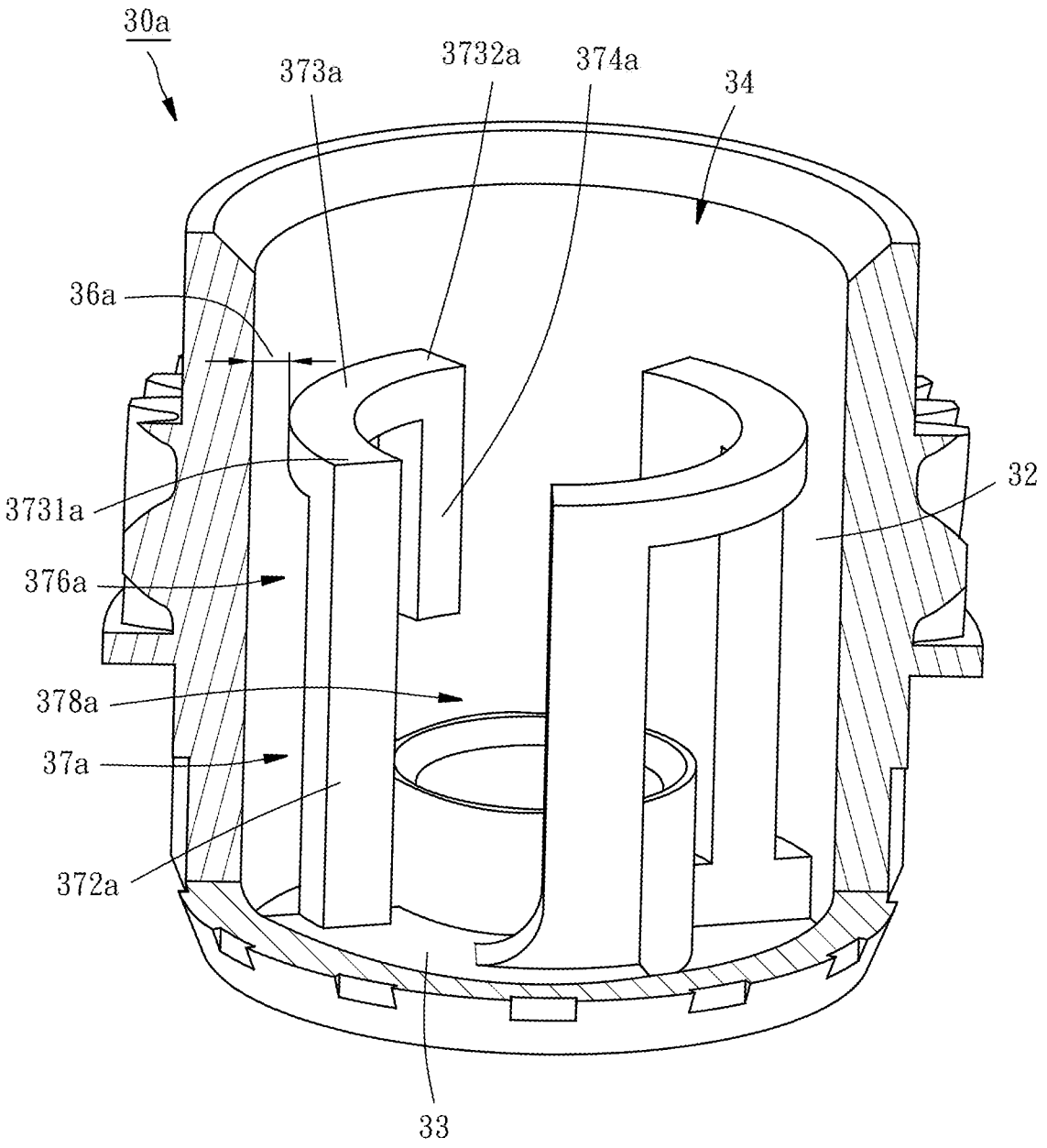
FIG. 10 is a cutaway perspective view of a connecting member of a roller unit in accordance with a second embodiment of the present invention.

Based on the above-mentioned technical features, various modifications to the structure of the connecting member may be made. For example, FIG. 10 shows a connecting member 30*a* in accordance with a second embodiment of the present application. The structure of the connecting member 30*a* is basically the same as that of the connecting member 30, except that the second limit portion 37*a* of the connecting member 30*a* in this embodiment extends from the bottom portion 33 toward the opening 34 in a way that a gap 36*a* exists between the second limit portion 37*a* and the internal periphery of the tube portion 32. That is, the second limit portion 37*a* is not connected with the internal periphery of the tube portion 32, and configured having a first axially extending portion 372*a*, an arc portion 373*a*, a second axially extending portion 374*a* and a second notch 376*a*. The first axially extending portion 372*a* has an end connected with the bottom portion 33, and the other end connected with a first end 3731*a* of the arc portion 373*a*. The second axially extending portion 374*a* has an end connected with a second end 3732*a* of the arc portion 373*a*, and the other end spaced from the bottom portion 33 at a predetermined distance, such that a breach 378*a* exits between the other end of the second axially extending portion 374*a* and the bottom portion 33. The second notch 376*a* is surrounded by the first axially extending portion 372*a*, the arc portion 373*a* and the second axially extending portion 374*a*, and communicated with the breach 378*a*. With such design, the connecting member 30*a* has an equivalent function of the connecting member 30 of the first embodiment.

Figure 11:
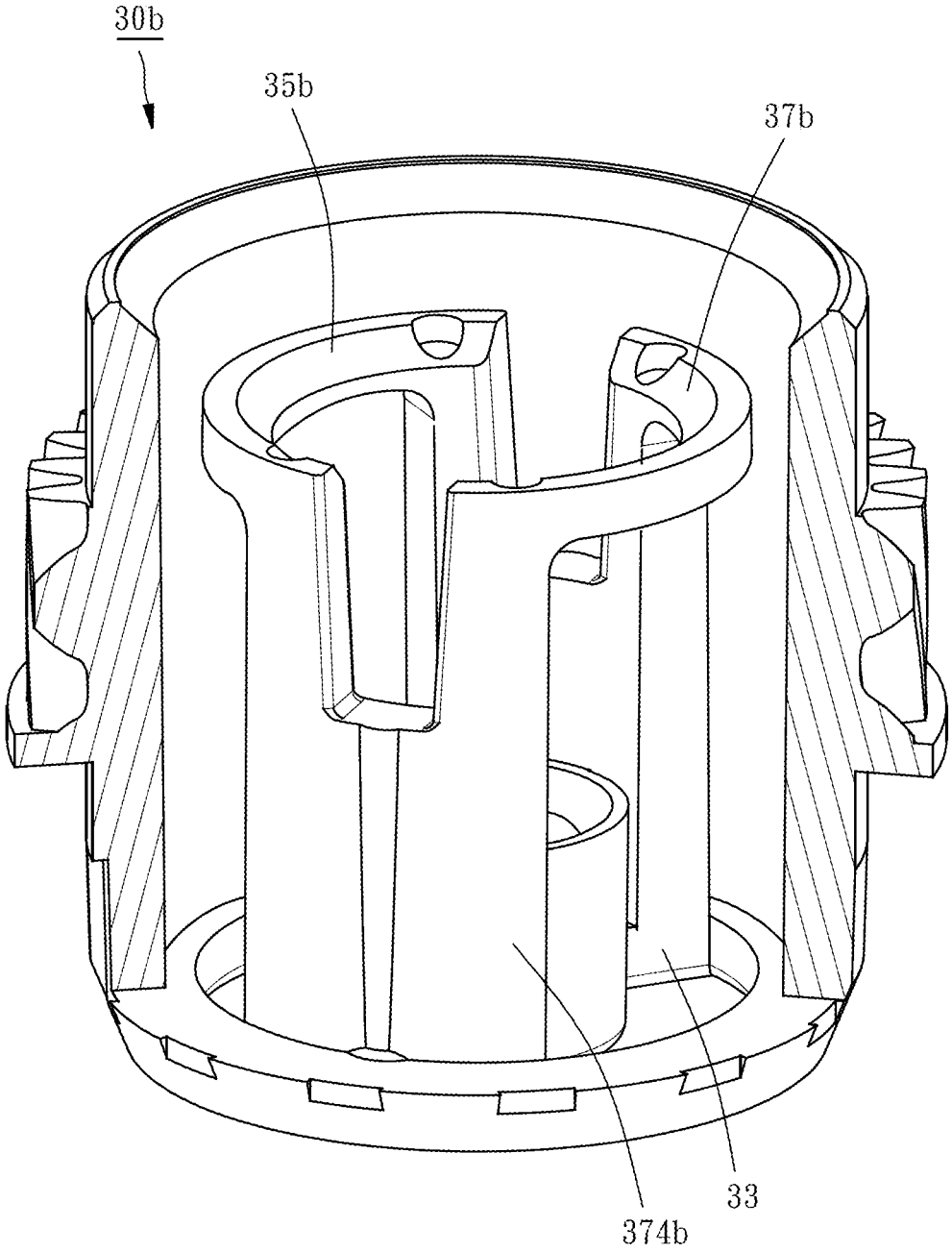
FIG. 11 is a cutaway perspective view of a connecting member of a roller unit in accordance with a third embodiment of the present invention.

Further, FIG. 11 shows a connecting member 30*b* in accordance with a second embodiment of the present application. The structure of the connecting member 30*b* is basically the same as that of the connecting member 30*a* of the second embodiment, except that the bottom end of the second axially extending portion 374*b* of the second limit portion 37*b* is directly connected with the bottom portion 33, such that the second limit portion 37*b* has no breach. Because the first, limit portion 35*b* and the second limit portion 37*b* both have no such a breach, when the rotational force receiving member is assembled to the connecting member 30*b*, the first and second limit portions 35*b*, 37*b* must be pushed outwardly to elastically deform first, and then the two limit posts of the rotational force receiving member are inserted into the first and second notches 356*b*, 376*b* respectively, and thereafter the force exerting on the first and second limit portions 35*b*, 37*b* is released to enable the first and second limit portions 35*b*. 37*b* to return to their initial shapes so as to complete the installation of the rotational force receiving member to the connecting member 30*b*. The connecting member 30*b* has an equivalent function of the connecting member 30 of the first embodiment.

In fact, as long as the first limit portion of the connecting member extends from the bottom portion toward the opening in a way that a gap is left between the first limit portion and the internal periphery of the tube portion, either the design that the second limit portion extends from the internal periphery of the tube portion toward the first limit portion or the design that the second limit portion extends from the bottom portion toward the opening in a way that a gap is left between the second limit portion and the internal periphery of the tube portion should be included within the scope of the present invention. Further, the structures and shapes of the first and second limit portions may be modified as long as the first and second limit portions have the first and second notches capable of being inserted by the two limit posts of the rotational force receiving member. Furthermore, the second limit portion may be provided with a breach as shown in the first and second embodiments or without a breach as shown in the third embodiment.

In conclusion, the connecting member provided by the present invention is able to be coupled with a rotational force receiving member in a way that the rotational force receiving member is freely swingable within an angle range relative to the connecting member without being detached from the connecting member, thereby achieving the objectives of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A roller unit of an electronic image-forming apparatus, comprising:

a roller;

a connecting member having a tube portion fixedly mounted to an end of the roller, a bottom portion provided at an end of the tube portion, an opening provided at the other end of the tube portion, a first limit portion extending from the bottom portion toward the opening in a way that a gap is left between the first limit portion and an internal periphery of the tube portion, and a second limit portion located inside the tube portion and spacedly facing the first limit portion; wherein the tube portion has an axis, the first limit portion has a first notch, and the second limit portion has a second notch;

a rotational force receiving member having an axle portion, and two limit posts protruding radially from the axle portion and extending into the first notch and the second notch, respectively; and a resilient member connected between the connecting member and the rotational force receiving member;

whereby the rotational force receiving member is freely swingable from the axis toward any direction at a predetermined angle relative to the connecting member.

2. The roller unit of the electronic image-forming apparatus as defined in claim 1, wherein the second limit portion protrudes from the internal periphery of the tube portion toward the first limit portion.

3. The roller unit of the electronic image-forming apparatus as defined in claim 2, wherein the second limit portion comprises a first axially extending portion, an arc portion, and a second axially extending portion; the first axially extending portion has an end connected with the bottom portion, and the other end connected with a first end of the arc portion; the second axially extending portion has an end connected with a second end of the arc portion, and the other end spaced from the bottom portion at a predetermined distance, such that a breach is left between the other end of the second axially extending portion and the bottom portion; the second notch is surrounded by the first axially extending portion, the arc portion and the second axially extending portion and communicated with the breach.

4. The roller unit of the electronic image-forming apparatus as defined in claim 3, wherein the resilient member has an end portion connected with the rotational force receiving member and provided with a stopper portion located inside the second notch and between one of the limit posts of the rotational force receiving member and the second axially extending portion of the second limit portion.

5. The roller unit of the electronic image-forming apparatus as defined in claim 2, wherein the second limit portion has a breach communicated with the second notch.

6. The roller unit of the electronic image-forming apparatus as defined in claim 1, wherein the second limit portion of the connecting member extends from the bottom portion toward the opening in a way that a gap exists between the second limit portion and the internal periphery of the tube portion.

7. The roller unit of the electronic image-forming apparatus as defined in claim 6, wherein the second limit portion comprises a first axially extending portion, an arc portion, and a second axially extending portion; the first axially extending portion has an end connected with the bottom portion, and the other end connected with a first end of the arc portion; the second axially extending portion has an end connected with a second end of the arc portion, and the other end spaced from the bottom portion at a predetermined distance, such that a breach is left between the other end of the second axially extending portion and the bottom portion; the second notch is surrounded by the first axially extending portion, the arc portion and the second axially extending portion and communicated with the breach.

8. The roller unit of the electronic image-forming apparatus as defined in claim 4, wherein the second limit portion comprises a first axially extending portion, an arc portion, and a second axially extending portion; the first axially extending portion has an end connected with the bottom portion, and the other end connected with a first end of the arc portion; the second axially extending portion has an end connected with a second end of the arc portion, and the other end connected with the bottom portion; the second notch is surrounded by the first axially extending portion, the arc portion and the second axially extending portion.

9. The roller unit of the electronic image-forming apparatus as defined in claim 1, wherein the first limit portion comprises two axially extending portions extending from the bottom portion toward the opening, and an arc portion connected between two ends of the two axially extending portions; the first notch is surrounded by the two axially extending portions and the arc portion.

10. The roller unit of the electronic image-forming apparatus as defined in claim 1, wherein the resilient member is a spring having an end sleeved onto a protrusion ring that extends from the bottom portion of the connecting member toward the opening.

11. The roller unit of the electronic image-forming apparatus as defined in claim 1, wherein the rotational force receiving member comprises a sphere disposed at an end of the axle portion and located between the first and second limit portions.

12. The roller unit of the electronic image-forming apparatus as defined in claim 11, wherein the rotational force receiving member comprises a limit pin penetrating through the sphere and the axle portion in a way that two end portions of the limit pin form the two limit posts.

* * * * *